United States Patent [19]

DuBois

[11] Patent Number: 4,560,156

[45] Date of Patent: Dec. 24, 1985

[54] DEVICE FOR DROP-FEEDING SHEET MATERIAL INTO A PRINTING APPARATUS OR THE LIKE

[76] Inventor: R. Clark DuBois, 332 Wakeman Rd., Fairfield, Conn. 06430

[21] Appl. No.: 558,945

[22] Filed: Dec. 7, 1983

[51] Int. Cl.[4] ..... B65H 9/06; B65H 3/00

[52] U.S. Cl. ..... 271/18; 271/9; 271/246; 271/4; 271/10; 400/625

[58] Field of Search ..... 271/4, 8, 9, 10, 18, 271/227, 245, 246, 31.1; 400/625; 221/82-86

[56] References Cited

U.S. PATENT DOCUMENTS

| | | | |
|---|---|---|---|
| 2,267,502 | 12/1941 | Lewis | 400/624 |
| 2,366,206 | 1/1945 | Metzner | 400/625 |
| 3,523,685 | 8/1970 | Ehlscheid | 271/9 |
| 3,652,083 | 3/1972 | Bosshardt | 271/246 |
| 3,653,482 | 4/1972 | Cortona et al. | 400/603 |
| 3,659,837 | 5/1972 | Umahashi | 271/9 |
| 3,765,327 | 10/1973 | Aronson et al. | 271/9 |
| 4,146,326 | 3/1979 | Taylor et al. | 271/246 |
| 4,222,557 | 9/1980 | Wu | 271/4 |
| 4,248,415 | 2/1981 | Steinhilber | 271/9 |
| 4,253,652 | 3/1981 | Steinhilber | 271/9 |
| 4,285,607 | 8/1981 | Steinhilber | 271/9 |
| 4,326,815 | 4/1982 | Kapp | 271/4 |
| 4,431,323 | 2/1984 | Kulow | 271/4 |

FOREIGN PATENT DOCUMENTS

| | | | |
|---|---|---|---|
| 256525 | 12/1966 | Austria | 221/81 |
| 664564 | 7/1963 | Canada | 271/9 |

*Primary Examiner*—Bruce H. Stoner, Jr.
*Assistant Examiner*—James E. Barlow
*Attorney, Agent, or Firm*—Francis J. Bouda

[57] ABSTRACT

A drop sheet feeder for mounting above the platen of a printing apparatus has a plurality of upstanding trays moved by a tray shifting device to release individual sheets of paper stored therebetween. The platen drive of the printing apparatus is operatively connected with the drop sheet feeder to release the individual sheets of material sequentially. A sheet feeding device of the drop sheet feeder is operatively engageable with the released sheet of sheet material to feed the sheet into engagement with the insert portion of the feed path about the platen of the printing apparatus. The drop sheet feeder can be used to feed individual sheets of material, multi-part form sets or envelopes.

6 Claims, 10 Drawing Figures

DEVICE FOR DROP-FEEDING SHEET MATERIAL INTO A PRINTING APPARATUS OR THE LIKE

BACKGROUND OF THE INVENTION

Most printers, typewriters, word processing machines and the like are arranged for typing or printing one sheet (or sets of sheets) of paper at a time. Some of these machines are provided with pin feed platens or tractors adapted to feed continuous strips or webs of paper material, but these machines are generally data processing and word processing printers of a more complicated construction. For letter quality type printers, generally a single sheet of paper is fed into the printing apparatus.

One of the disadvantages of the single sheet feed construction (either for letter size sheets or for envelopes) is that the operator must manually insert and register the sheet at the insert side of the platen and feed the sheet into the feed path thereabout. This procedure is extremely time consuming when large numbers of documents are being prepared by the printing apparatus.

Further, in many of the prior art sheet feeding devices, it is difficult to feed sequentially differently shaped or sized sheets of material. Especially difficult to feed are limp sheet material and envelopes with rolled edges which cannot be satisfactorily handled by the feeding devices of the prior art.

The term 'sheet' as contemplated by the present invention is used to describe a single sheet, folded sheet such as an envelope and a unitary, multi-part form set having a plurality of interengaged sheets.

"Sheet material" as used herein refers to paper, synthetic resin, metal foil and laminates.

It is an object of the present invention to provide a novel drop sheet feeder for printing apparatus which will readily effect edge alignment of the materials being fed to increase the efficiency of printing apparatus and thereby the operator.

It is also an object to provide such a drop sheet feeder which enables the operator to provide different styles, sizes or forms of sheet materials to be fed in sequence about the platen of the printing apparatus.

Another object is to provide such a drop sheet feeder which will readily and accurately register and feed limp sheet material and envelopes with rounded edges.

A further object is to provide such a drop sheet feeder which may be fabricated readily and relatively economically and which will enjoy a long life in operation.

SUMMARY OF THE INVENTION

It has now found that the foregoing and related objects can be readily attained in a drop sheet feeder which includes a frame mounted on a printer or the like and a sheet feed device supported in the frame for advancing an associated sheet of material introduced thereinto along a feed path to the printing platen. A plurality of trays are adapted to receive at least one sheet of sheet material therebetween, while the frame includes means supporting the plurality of trays in a generally upstanding position with above the sheet feed device for reciprocal movement between a sheet retaining position and a sheet releasing position. A shifting mechanism can move selected trays in sequence from the sheet retaining position to sheet releasing position for introducing the associated sheets of sheet material in a position behind the selected one of the trays into the feed path defined by the sheet feeding device.

A blocking device is movably mounted on the frame for movement into the feed path of the drop sheet feeder to position the associated sheets of sheet material following their release from the plurality of trays. A device is provided for removing the blocking device from the drop sheet feeder feed path of the associated sheets of sheet material.

In the preferred embodiment, the sheet feeding device drivingly engages and advances the associated sheet along the drop sheet feeder feed path. The sheet feeding device includes a first roller mounted on one side of the drop sheet feeder feed path and a second roller on the other side thereof pivotally mounted on the frame and biased towards the first roller whereby the moving means moves the blocking device from the feed path to release the associated sheet of sheet material while the first and second rollers of the sheet feed device engage the associated sheets of sheet material and advance it along the drop sheet feeder feed path.

Desirably, the shifting device of the present invention includes a picker finger having a tray engaging end and a cam follower end, the finger being oscillatably mounted on the frame for sequentially moving the trays between the retaining and release positions. While a cam is operatively disposed adjacent the cam follower and to rotate the picker finger to sequentially move the plurality of trays and release the associated sheets of sheet material. The trays may have magnetic holders at the upper end portions thereof for retaining the upper ends of the plurality of trays in close proximity of one another and a pair of trunnions extending therefrom. The holders and trunnions cooperating to space adjacent trays from one another for reception of the associated sheets of material therebetween.

Conveniently, the supporting means in the frame includes a pair of angular slots having portions of the plurality of trays received therein. The trays are slidable within the slot from the sheet retaining position to the sheet release position.

Ideally, the printing apparatus has a platen which is rotatably mounted and drive means for rotating the platen. Gear train drive means for the drop sheet feeder operatively connects first roller and the shifting means with the platen for rotation therewith. A linkage connects the blocking means for operation in unison with the shifting means.

As a result, the operator may place various types of sheets, envelopes, etc. in the proper sequence in the trays and the drop feeder will shift the lowermost tray member in the angular slots to drop the individual sheet material which has been positioned between the two trays against the blocking member. The sheet feeding device advances the sheet to the platen, where it may be drawn into typing position to receive impact of the typewriter element or printer element.

The invention will be fully understood when reference is made to the following detailed description taken in conjunction with the accompanying drawings.

DETAILED DESCRIPTION OF THE PREFERRED EMBODIMENT

Figure 1:
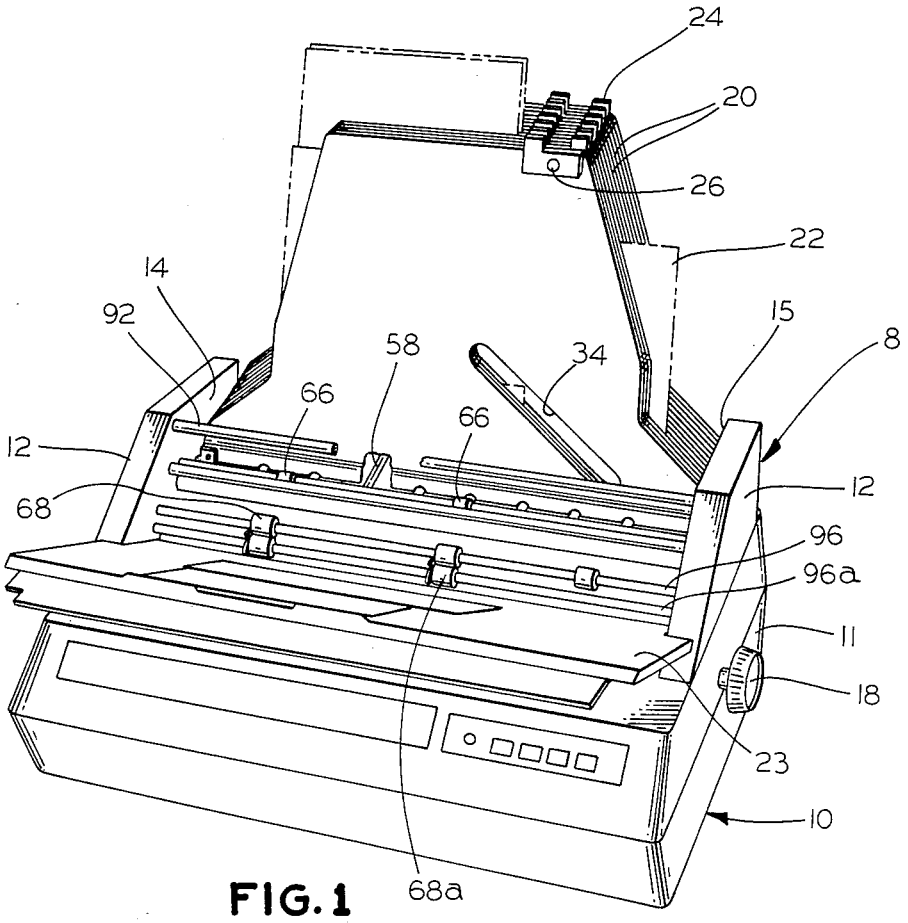
FIG. 1 is a perspective view of a drop sheet feeder embodying the present invention as mounted upon a printer of the type employed in data and word processing systems, and showing in phantom line sheets of paper disposed therein.

Referring first to FIG. 1, therein is illustrated a drop sheet feeder embodying the present invention and generally designated by the numeral 8 as used in combination with a conventional printer generally designated by the numeral 10. The printer 10 has a housing or cover 11 and a mechanically driven rotatably mounted platen 16 (seen in FIG. 3) which defines a portion of a printer sheet feed path thereabout. The platen 16 of the printer 10 can be rotated manually by use of the manual feed knobs 18 (one shown) located on either side of the printer 10, as is conventional.

The drop sheet feeder 8 has a pair of spaced side frames or plates 14, 15 which seat upon the housing 11 of printer 10 to position the drop sheet feeder 8 above the platen 16. A plurality of upstanding trays or plates 20 are movably supported in the feeder 8 for vertically positioning sheets 22 of sheet material therebetween to be fed into the drive path about the platen 16 of the printer 10. Movement of the trays 20 to release the paper 22 or other sheet material to the printer is effected by the gear drive mechanism illustrated in FIGS. 3 and 4 and generally designated by the numeral 54. A registration stop mechanism and a sheet feeding roller device illustrated in FIGS. 5 and 6 and generally designated by the numeral 21 operate in conjunction with the drive mechanism 54 as will be explained hereinafter, to release the sheets 22 of sheet material sequentially from the stored position between the trays 20 into the feed path about the printer platen 16. An exit tray 23 is inclined upwardly to receive the sheets 22 exiting from the printer 10 and the drive path through the feeder 8.

Figure 2:
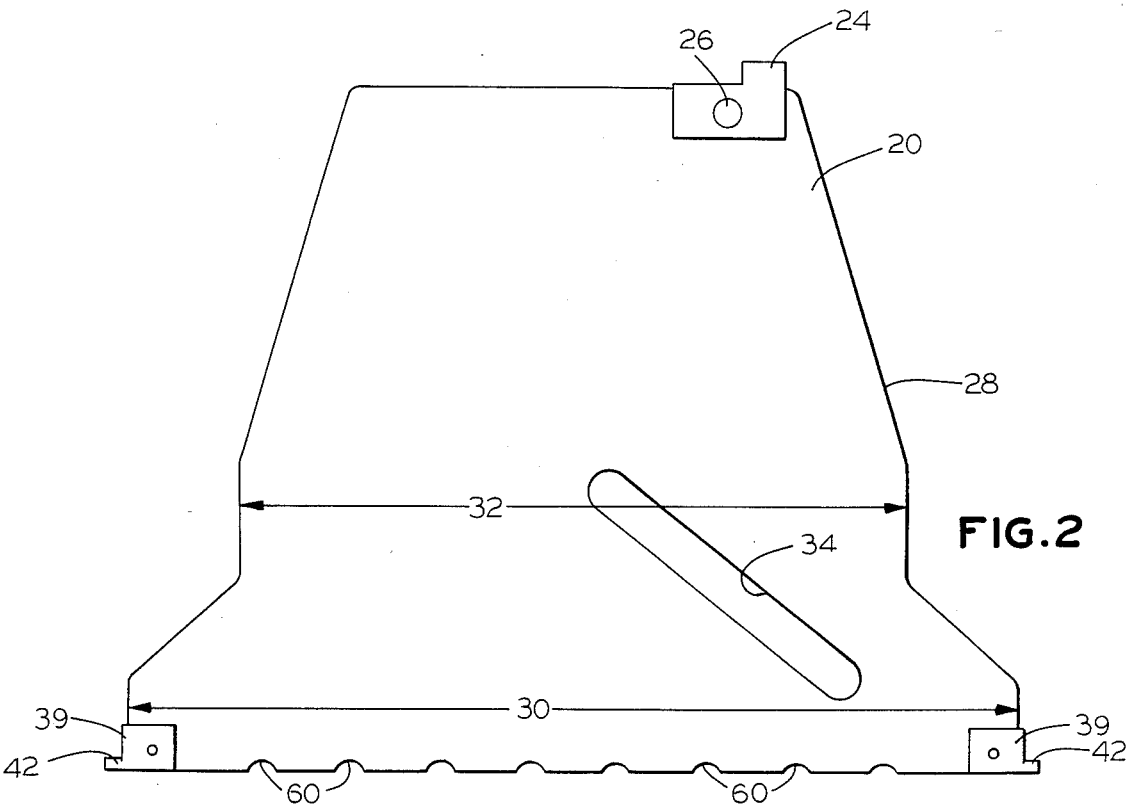
FIG. 2 is a front elevational view of one of the trays in the drop sheet feeder.

Turning in detail first to the trays 20 as best seen in FIGS. 1 and 2, they have tab elements 24 mounted at one side of the upper edge portion so as not to interfere with different sizes of sheet material which may be placed therein. Magnets 26 on the tab elements 24 hold the top portions of trays 20 in position against one another but allow their easy separation. Accordingly, the trays 20 may be easily pivoted toward the machine operator for loading the sheet material 22 therebetween and then pivoted back to the position seen in FIG. 1.

The lower portion 30 of the trays 20 is its widest portion, and a transition is made therefrom to the narrower intermediate registration portion 32. The upper portion 28 tapers from the registration portion 32 to provide a reduced width at the top edge. As indicated in FIG. 1, the edges of the sheets 22 are registered with the left edge of the registration portion 32 of the trays 20. At the side edges of the lower portion 30 of the trays 20 are edge guides 39 with laterally projecting arms or trunnions 42 which are pivotably and slidably seated in the side frame members 14, 15. The lower edge of the trays 20 is provided with arcuate notches 60 for a purpose to be described more fully hereinafter. Inclined slots or cutouts 34 are provided in the lower portion 30 and registration portion 32 so that the sheets 22 held therebetween are visible.

Figure 3:
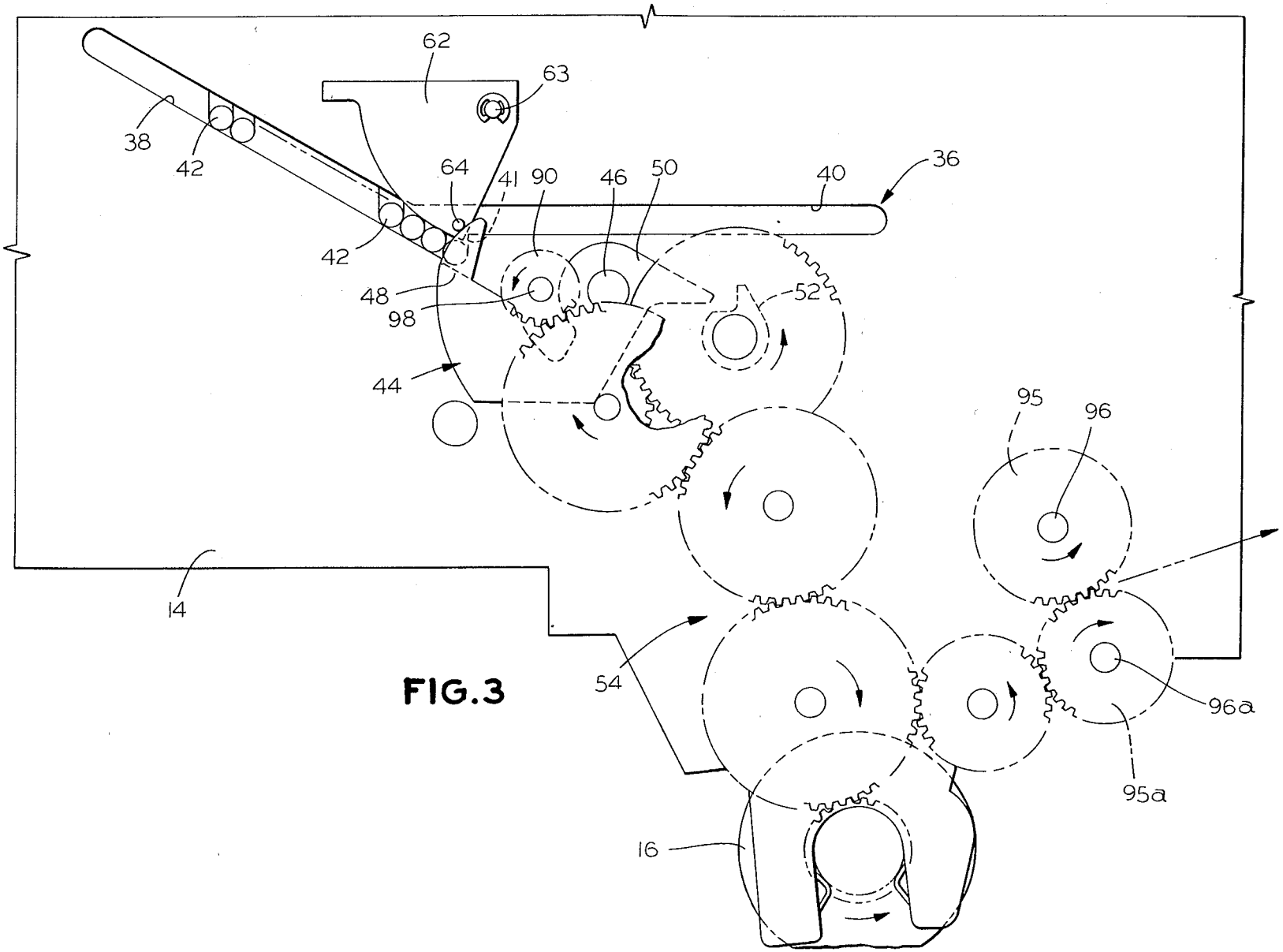
FIG. 3 is a partially schematic, fragmentary elevational view of the left side of the printer and drop sheet feeder assembly as seen in FIG. 1, wherein portions of some elements have been broken away and other elements have been omitted to show the drive mechanism for the feeder coupled to the printer platen and the picker finger in its lowermost position.
Figure 4:
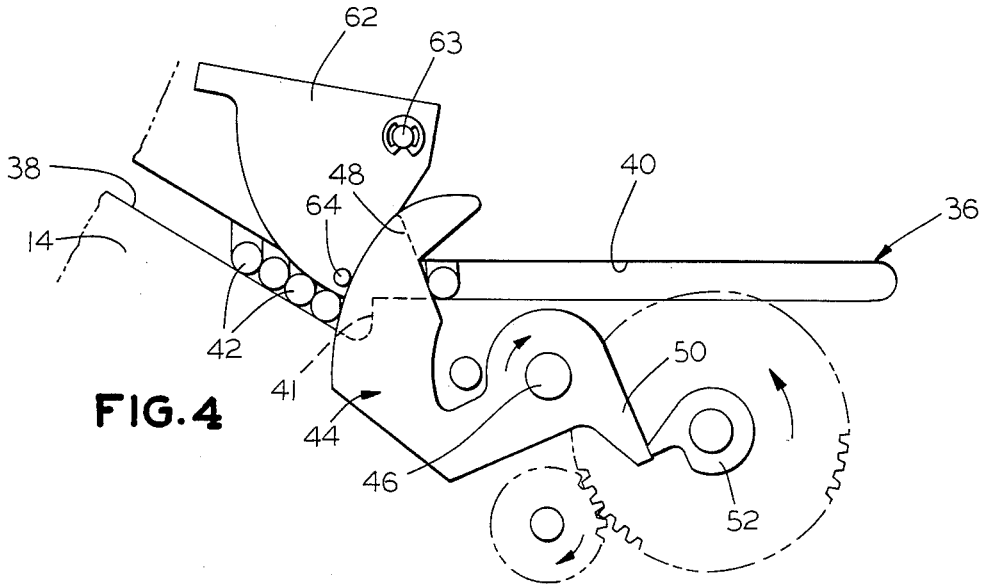
FIG. 4 is a partially schematic fragmentary elevational view similar to FIG. 3 showing the tray shifting mechanism with the picker finger in its uppermost position.

Referring now to FIGS. 3 and 4, the mechanism for sequentially shifting the lower ends of the trays 20 from a sheet retaining or storage position to a sheet releasing position is illustrated. The trunnions 42 on the trays 20 are slidably and pivotally seated in slots formed in the side frame members 14, 15 and generally designated by the numeral 36. These slots 36 have a rearwardly and upwardly inclined sheet retaining portion 38 and a rearwardly extending horizontal or sheet releasing portion 40 which intersects the inclined portion 38 at a point spaced above its lower end to provide a step 41 at the point of intersection.

The trunnions 42 are engageable by a pair of picker fingers generally designated by the numeral 44 (only one shown) pivotably supported outwardly of the side frame plates 14, 15 on the ends of the picker finger shaft or crossbar 46 which in turn is rotatably supported in the side frame plates 14, 15. Each of the picker fingers 44 has a tray engaging portion 48 at one end thereof cooperating with the trunnions 42 of the plurality of trays 20, and a cam follower portion 50 at the other end thereof.

The cam follower portion 50 of the picker finger 44 adjacent side frame 14 (the left side) is engaged by the rotatable cam 52, which in turn is drivingly interconnected with the platen 16 of the printing apparatus 10 by the gear train or other suitable drive mechanism generally designated by the numeral 54 in FIG. 3. Movement of the platen 16 in the counterclockwise direction as seen in FIG. 3 (normal driven direction of rotation of the platen 16) will produce counterclockwise movement of the cam 52 as seen in FIGS. 3 and 4. The rotating cam 52 engages the cam follower portion 50 of the picker finger 44 and thereby rotates both picker fingers 44 and their shaft 46 with respect to the side frames 14, 15.

As the picker fingers 44 rotate, the tray engaging portions 48 come into contact with the spaced trunnions 42 of the lowermost tray 20 in the sheet retaining portion 38 of the slots 36 which tray is seated against the step 41 of the slots 36. Further rotation of the cam 52 and the picker fingers 44 as shown in FIG. 4 lifts the trunnions 42 over the step 41 into the sheet releasing portion 40 of the slots 36 and thereby shifts the lowermost tray 20 upwardly from its sheet retaining position to the sheet releasing position, causing a spacing between its lower end and the next adjacent or second in line tray, and permitting the sheet 22 captured therebetween to drop under the force of gravity into the position shown in FIG. 5.

Figure 10:
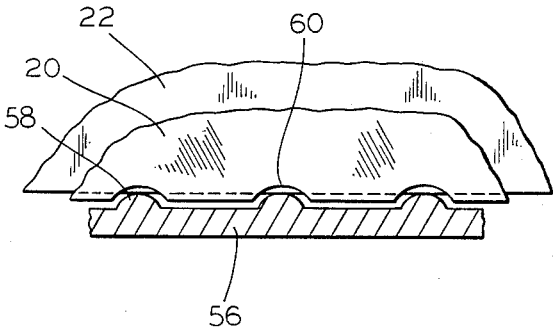
FIG. 10 is an enlarged fragmentary view of the inclined lower plate shown in section, one of the plurality of trays, and a sheet of sheet material therebehind.

As previously described, the trays 20 are guided in the slots 36 in side frames 14, 15 by the trunnions 42 and the lower ends of the trays 20 are supported thereby in spaced relationship above the surface of the inclined support plate 56 which extends between the side frames 14, 15. The support plate 56 has a plurality of ribs or bosses 58 extending along its upper surface as illustrated in FIG. 10. As also seen in FIG. 10, the notches 60 in the lower edges of the trays 20 are cooperatively dimensioned and configured with respect to the ribs 58 so that the lower edge of the trays 20 extends in a plane below the plane defined by the crowns of the ribs 58. This arrangement allows the sheets 22 to seat on the ribs 58 but prevents them from sliding under the lower edges of the trays 20 as they slide downwardly until they fall off the lower end of the support plate 56.

A pair of trunnion stops 62 (FIGS. 3–4 and 9) are pivotally mounted by the pivot pins 63 on the side frames 14, 15 adjacent the slots 36 therein and have their lower, forward ends disposed adjacent the steps 41 as seen in FIG. 3 so as to overlie the trunnions 42 of the lower trays 20. The rearward face, i.e., that facing the trunnions 42, is arcuate so that it can pivot over the tops of the trunnions 42. Upon pivoting of the picker fingers 44 upwardly from the position shown in FIG. 3 to the position shown in FIG. 4, their tray engaging ends 48 will not only pick up the trunnions 42 of the tray 20 seated against the step 41 but also engage the studs 64 on the trunnion stops 62 and thereby rotate the stops 62 about their pivotal axis to allow passage of only that one tray 20 which is disposed against that step 41, over the step from the retained position to the released position. Thus, the trunnion stops 62 prevent any frictional forces between the two lowermost adjacent trays 20 from lifting them simultaneously as the picker fingers 44 guide the lowermost tray 20 over the step 41 into the released position.

The studs 64 abut the picker fingers 44 to define the lowermost position of the trunnion stops 62 as shown in FIG. 3. In their lowermost position, the trunnion stops 62 overlie the step 41 in the slots 36 and prevent the lowermost tray 20 from moving to the sheet release portion 40 of the slot 36 even if the trays 20 were to be jarred.

The gear train 54, which is seen in FIG. 3, links the platen 16 and the picker cam 52 and may be provided with an overall gear ratio such that the picker cam 52 is rotated or advanced one complete rotation every fifteen inches of net forward surface motion of the platen 16, i.e. circumferential rotation in the clockwise direction. Thus, the picker fingers 44 will advance a tray 20 and drop a sheet 22 in the same interval. Any interval of net forward platen motion can be chosen to drop a sheet 22 by providing the proper gear ratio. Additionally, the gear train 54 is operatively connected to the gear 90 mounted on the rotatable shaft or crossbar 98 which effects rotation of a pair of stuffer rollers 66 spaced along the shaft 98 between the side frames 14, 15. It also effects rotation of the gears 95 on the shafts 96 to produce rotation of two pairs of exit rollers 68, 68*a* mounted on the shafts 96, 96*a* between the side frames 14, 15, as will be described hereinafter.

Figure 7:
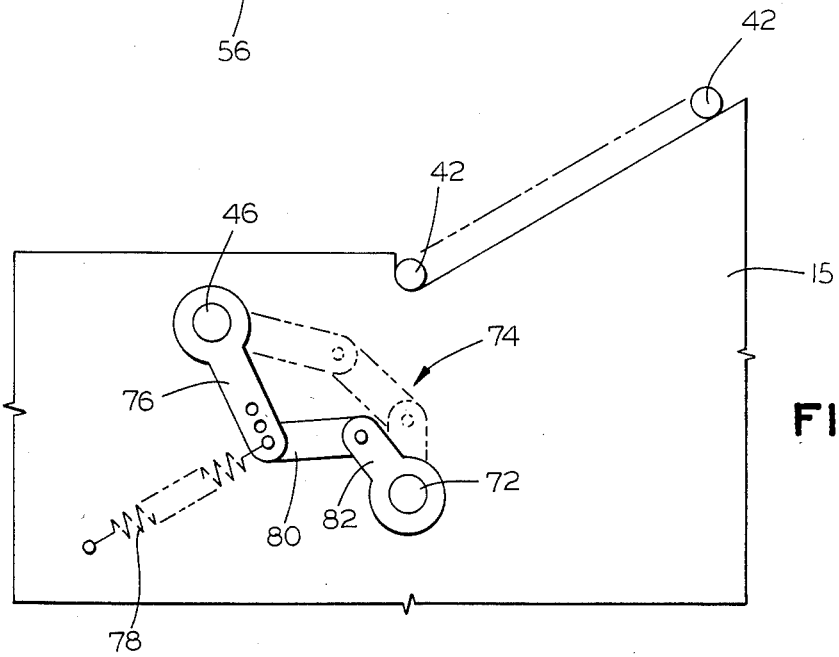
FIG. 7 is a fragmentary right side elevational view of the linkage mechanism shown in its two extreme positions with the picker finger and cover omitted for clarity of illustration.
Figure 5:
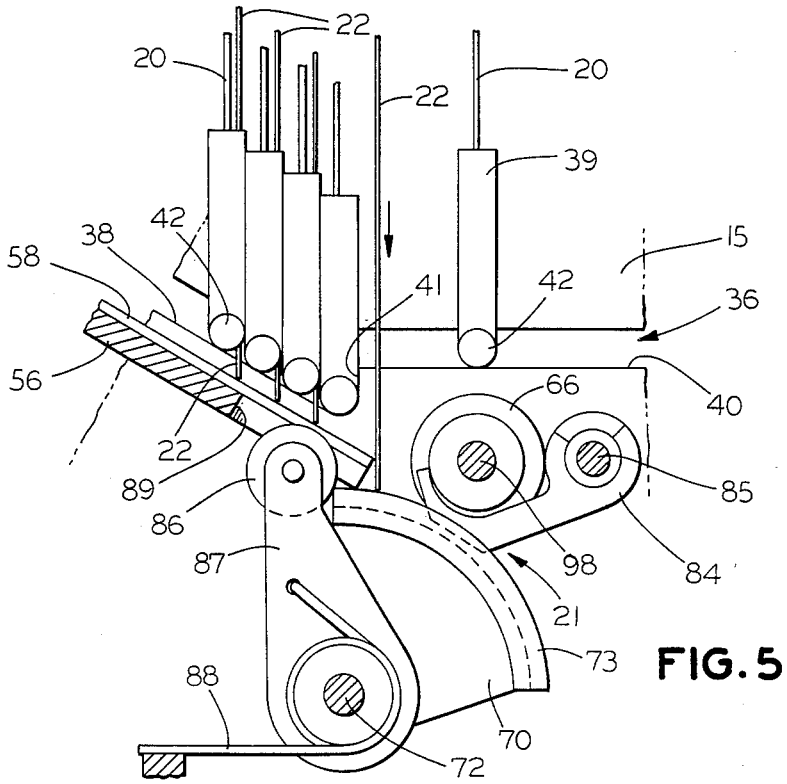
FIGS. 5 and 6 are fragmentary, partially sectional views of the registration stop mechanism and the sheet feeding mechanism shown in their alternate positions.
Figure 6:
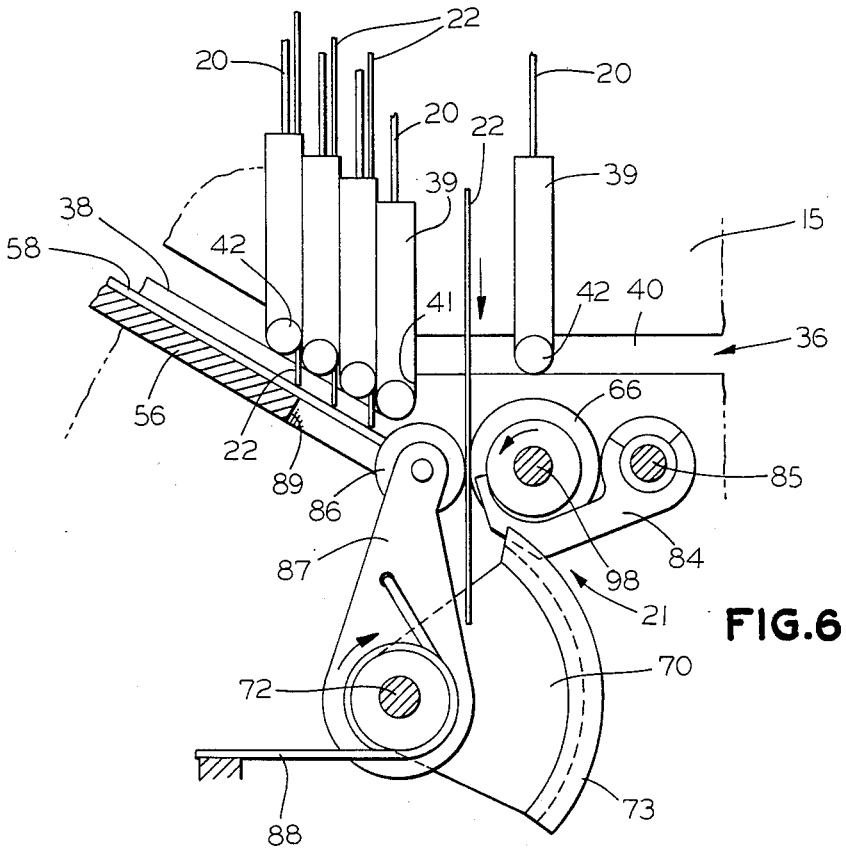

Referring now to FIGS. 5–7, a registration stop or blocker 70 is mounted spaced from the side frames 14, 15 on the registration stop shaft or crossbar 72 for rotation therewith into positions wherein the stop 70 opens or blocks the feed path of the released sheet 22 as it drops off the support plate 56. As illustrated in FIG. 5, the blocking position of the stops 70 are located a short distance (approximately one-quarter of an inch) under the edge of the support plate 56 to stop the sheet 22 as it drops from its position between the first pair of trays 20. It is important that the drop of the sheet 22 to the registration stop 70 be a relativey small distance so as to prevent bounce or side movement of the sheet 22 as it abuts the registration stops 70. To provide this relatively small distance, the stop 70 is provided with relief grooves 73 corresponding to the positions of rollers 66 and stops 84. During movement of the stop 70 between the open and blocked positions with respect to the feed path of the released sheet, the rollers 66 and stop 84 will be disposed within the relief grooves 73.

A linkage generally designated by the numeral 74 is shown in FIG. 7 and is located outwardly of the right-hand side frame 15 to effect rotation of the stop 70 in unison with the mechanism for sequentially shifting the trays 20. The linkage 74 includes the actuator link 76 which is mounted on the picker finger shaft 46 and is biased by the tension spring 78 into the position shown. An intermediate link 80 connects the actuator link 76 with the registration stop link 82 which is mounted on the registration stop shaft 72. This arrangement enables the picker cam 52 to engage the associated picker finger 44 and rotate the picker finger shaft 46, thereby rotating the linkage 74 from the position shown in solid line in FIG. 7 to the position shown in phantom line. Meanwhile, the registration stop 70 will be rotated in unison from the open or non-blocking position seen in FIG. 6 to the blocking position shown in FIG. 5 to position or register the leading edge of the sheet 22 in a spaced position above the printer platen 16. The combined picker cam/linkage operating mechanism provides the registration stop 70 with a nonlinear velocity profile which effects fast movement of the stop 70 as the cam 52 initially engages, and thereafter disengages from the picker finger 44.

Two or more stops 84 are mounted on a shaft or crossbar 85 adjacent the stuffer rollers 66 between the side frames 14, 15, and are positioned to prevent a sheet 22 from overriding the stop 70. Without these stops 84, a sheet 22 with a bent leading edge could slide along the stop 70 and prevent proper registration of the lower edge of the sheet 22 and movement into the sheet feed path.

Pivotally mounted on the registration stop shaft 72 are a pair of arms 87 on the ends of which are journalled the stuffer rollers 86 (only one shown in FIGS. 5 and 6). The springs 88 bias the arms 87 about the registration stop shaft 72 to move the stuffer rollers 86 and thereby the released sheet 22 against the stuffer rollers 66 where the sheet 22 is captured in the nip defined between the rollers 66, 86. As illustrated in FIGS. 5 and 6, the inclined support plate 56 has a pair of slots or cutouts 89 at the lower edge thereof spaced inwardly from the side frames 14,15 in which the stuffer rollers 86 are movable.

The shaft 98 upon which are mounted the stuffer rollers 66 has a gear 90 thereon which is part of the gear train 54. Thus, the sheet 22 captured in the nip between stuffer rollers 66, 86 will be moved downwardly along the sheet feed path as the platen 16 and gear train 54 are rotated. It should be noted that the rollers 66, 86 will grasp the sheet 22 at a point spaced upwardly from its lower or leading edge. This allows envelopes with a thick or rolled edge to be positively gripped above this edge and to be fed by the apparatus.

Spaced above and forwardly of the platen 16 are two cooperating pairs of exit rollers 68, 68*a* which are mounted on the shafts 96, 96*a* journalled in the side frames 14, 15. These shafts have gears 95, 95*a* which are a part of the gear train 54 so as to rotate therewith. The rollers 68*a* have a pair of cams 94 at the sides thereof to push the trailing end of the associated sheet material 22 from the printer 10 onto an exit tray 23 which is pivotally supported on the frames 14, 15 adjacent the exit rollers 68, 68*a* as shown in FIG. 1 to receive the sheets 22 exiting therefrom.

Figure 8:
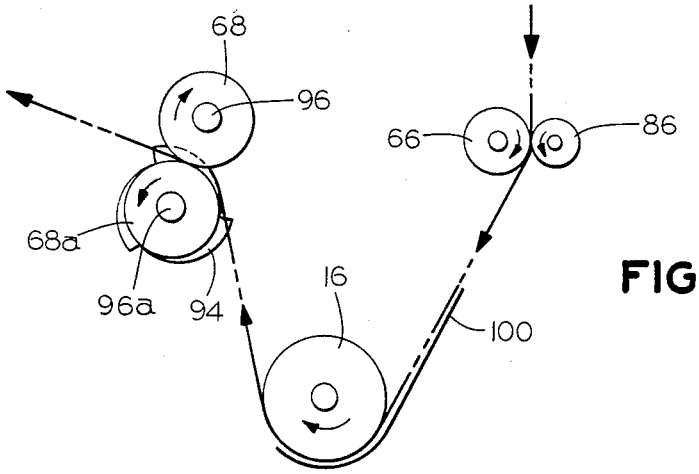
FIG. 8 is a schematic view of the feed path through the sheet feeder and printer.

Referring now to FIG. 8, the sheet feed path through the combined printer and drop sheet feeder is diagramatically illustrated. As seen therein, the sheet 22 will be moved along the feed path of the drop sheet feeder initially defined by the trays 20, and the edge of the inclined plate 56 and stuffer rollers 66, 86. The stuffer rollers 66, 86 will move the sheet 22 downwardly against the printer guide 100 on the insert side of the platen 16 of the printer 10 which cooperates with the platen 16 as is conventional for guiding the sheet 22 around the platen 16, defining the feed path through the printer 10. As the leading edge of the sheet 22 is advanced, it enters the nip defined by the exit rollers 68, 68*a* of the drop sheet feeder 8 to continue its feed path through the feeder 8 until it is pushed onto the exit tray 23.

Figure 9:
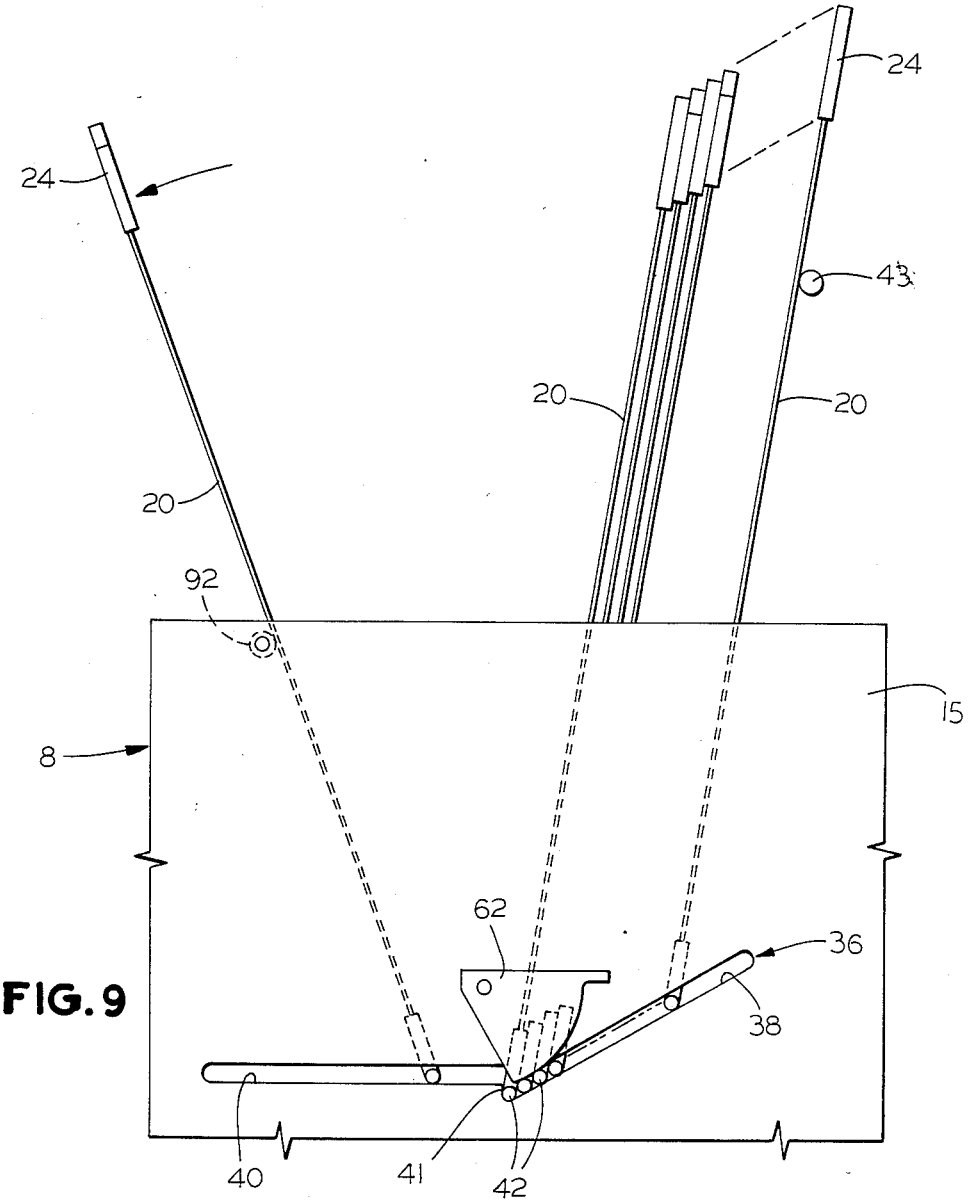
FIG. 9 is a fragmentary right side elevational view of the side frame and trays.

FIG. 9 illustrates the simple means for returning the trays 20 into their original sheet retaining positions. A tray pilot bar 92 shown as a fixed shaft is provided adjacent the upper, forward on the edge of the frame side plates 14, 15 against which the trays 20 may be pivoted rearwardly. After any number of the trays 20 have released their sheets, the trays 20 are returned to the sheet retaining portions 38 of the slots 36 by first gripping the upper edges of the trays 20 and pivoting them forward against the pilot bar 92 as depicted by the arrow in FIG. 9. When the upper edges of the trays 22 are pulled further forwardly, the trunnions 42 at the bottom edges of the trays 20 will slide rearwardly in the slot portion 40 towards the trunnion stops 62. As the trunnions 42 abut the trunnion stops 62, they cause the stops 62 to pivot out of blocking engagement and allow the trunnions 42 to drop off the step 41 and into the sheet retaining portion 38 of the slots 36. Desirably, a brace or bracket 43 (only fragmentarily shown in FIG. 9) is provided on the drop sheet feeder 8 and extends upwardly thereabove to function as a rest for the plurality of trays 20 in the sheet retaining position.

In operation, the trays 20 are positioned with their trunnions within the sheet retaining portion 38 of the slot 36 to be sequentially shifted by the shifting mechanism. The operator simply pivots the trays 20, loads the sheets 22 therebetween with their leftmost edges extending slightly beyond the left-hand edges of the intermediate registration portions 32 of the trays 20, and taps or pushes the leftmost edges of the extending sheets 22 so that they are flush or left registered with the intermediate registration portions 32. The trunnions 42 and tab elements 24 of the adjacent trays 20 cooperate to provide spacing therebetween for reception of the sheet 22 of sheet material without functionally engaging it.

To feed a sheet 22 manually, the operator simply rotates one of the manual feed knobs 18 on the end of the platen 16 to rotate the platen 16 and thereby operate the gear train 54. However, the movement is normally effected by the motor driven operation of the printer 10 and its platen 16 with the gear train 54 driving power therefrom to effect the operation of the elements of the drop sheet feeder 8. The picker cam 52 will rotate in the interval prescribed by the gear train 54 and will eventually engage the cam follower end 50 of the associated picker finger 44. Rotation of shaft 46 and picker fingers 44 within the frame 14, 15 will cause the trunnions 42 of the tray 20 positioned adjacent the step 41 to separate from the next adjacent tray 20. Additionally, the picker fingers 44 will engage the trunnion stops 62 to rotate them around their pivot axes to allow movement of the trunnions 42 of tray 20 over the step 41 from the sheet retaining portion 38 of the slot 36 to the sheet release portion 36 as seen in FIG. 5. Upon movement of the tray 20 to this position, the sheet 22 retained thereby drops from the lower edge of the inclined support plate 56 under the influence of gravity.

Concurrently, the picker finger shaft 46 rotates the linkage 74 from the position shown in solid line to the position shown in phantom line in FIG. 7. The stop registration shaft 72 rotate the registration stop 70 into position to block the released sheet 22 and open the stuffer rollers 66, 86. Continued rotation of the picker cam 52 subsequently releases the picker finger 44, thereby causing the linkage 74 to withdraw the registration stop 70 quickly from the feed path of the sheet 22. The stuffer rollers 86 are biased around the registration stop shaft 72 by spring 88 to cooperate with the stuffer rollers 66 to capture the released sheet 22 in the nip defined thereby. Further rotation of the platen 16 continues to rotate the stuffer rollers 66 by means of the gear train 54 thereby advancing the sheet 22 downwardly into engagement with the insert side of the platen 16. Further rotation of the platen 16 continues the movement of the sheet 22 about the platen 16 until it is in the desired position for printing thereon by the print element (not shown). As the printing operation continues, the platen 16 advances the sheet 22 one line at a time until its forward edge enters the nip between the exit rollers 68, 68*a* and is ultimately discharged into the exit tray 23.

As will be appreciated, as the first sheet 22 is moving about the platen 16, the operating elements are moving the trunnions 42 of the second tray 20 in the sequence over the step 41 in the slot 36 to cause a second sheet 22 to drop down into the sheet feed path. Similarly, as the second sheet 22 moves about the platen 16, the trunnions 42 of the tray 20 are moved to drop the third sheet 22 into the sheet feed path.

The conventional clamping or locking mechanism for positioning and preventing relative movement between the drop sheet feeder 8 and the printer 10 has not been shown in the illustrated embodiment. The clamping mechanism includes relatively pivotable clamp elements on each of the side frames 14, 15 having U-shaped slots therein and spring loaded latch members to engage about the shaft of the platen 16 of the printer 10 and clamp the drop sheet feeder 8 thereto.

Although a gear train may be used to replace the combined picker cam/linkage operating mechanism of the illustrated embodiment, the nonlinear velocity profile provided by the illustrated mechanism has been found superior since it allows the picker finger 44 and registration stop 70 to reciprocate quite rapidly into and out of their operative positions.

The sheet feeder can feed different styles, sizes or forms of sheet material including letter size paper, legal size paper and also handle envelopes and form sets of varying sizes.

Thus, it can be seen from the foregoing detailed specification and drawings that the efficiency of the printing apparatus and thereby the operator is increased by accurately feeding and registering various forms of sheet material.

Having thus described my invention, I claim:

1. A drop sheet feeder for moving sheets of sheet material from a storage location therein and along a sheet feed path to an associated printer or the like comprising:

a frame adapted to be mounted on a printer or the like, sheet feed means supported in said frame for advancing associated sheets of sheet material introduced thereinto along a sheet feed path registering at its end with a sheet feed path of the associated printer, a plurality of trays adapted to receive at least one sheet of sheet material therebetween, means supporting said plurality of trays in a generally upstanding position within said frame above said sheet feed means for reciprocal movement between a sheet retaining position and a sheet release position, means for shifting selected trays from said sheet retaining position to said sheet release position, said shifting means effecting sequential shifting of said trays for introducing the associated sheets of sheet material in a storage location between said selected trays into said feed path defined by said sheet feed means, means movably mounted on said frame for movement into said feed path defined by said sheet feed means to block said feed path defined by said sheet feed means and position the leading edges of the associated sheets of sheet material following their release from said plurality of trays, and said shifting means including a picker finger having a tray engaging end and a cam follower end, said finger being oscillatably mounted on said frame for sequentially moving said selected trays between the retaining and release positions, and a picker cam operatively disposed adjacent said cam follower end to rotate said picker finger to sequentially move said selected trays and release the associated sheets of sheet material.

2. A drop sheet feeder for moving sheets of sheet material from a storage location therein and along a sheet feed path to an associated printer or the like comprising:

a frame adapted to be mounted on a printer or the like, sheet feed means supported in said frame for advancing associated sheets of sheet material introduced thereinto along a sheet feed path registering at its end with a sheet feed path of the associated printer, a plurality of trays adapted to receive at least one sheet of sheet material therebetween, means supporting said plurality of trays in a generally upstanding position within said frame above said sheet feed means for reciprocal movement between a sheet retaining position and a sheet release position, means for shifting selected trays from said sheet retaining position to said sheet release position, said shifting means effecting sequential shifting of said trays for introducing the associated sheets of sheet material in a storage location between said selected trays into said feed path defined by said sheet feed means, means movably mounted on said frame for movement into said feed path defined by said sheet feed means to block said feed path defined by said sheet feed means and position the leading edges of the associated sheets of sheet material following their release from said plurality of trays, and each of said plurality of trays having a magnetic holder at the upper end portion thereof for retaining the upper ends of said plurality of trays in close proximity to each other.

3. A drop sheet feeder for moving sheets of sheet material from a storage location therein and along a sheet feed path to an associated printer or the like comprising:

a frame adapted to be mounted on a printer or the like, sheet feed means supported in said frame for advancing associated sheets of sheet material introduced thereinto along a sheet feed path registering at its end with a sheet feed path of the associated printer, a plurality of trays adapted to receive at least one sheet of sheet material therebetween, means supporting said plurality of trays in a generally upstanding position within said frame above said sheet feed means for reciprocal movement between a sheet retaining position and a sheet release position, means for shifting selected trays from said sheet retaining position to said sheet release position, said shifting means effecting sequential shifting of said trays for introducing the associated sheets of sheet material in a storage location between said selected trays into said feed path defined by said sheet feed means, means movably mounted on said frame for movement into said feed path defined by said sheet feed means to block said feed path defined by said sheet feed means and position the leading edges of the associated sheets of sheet material following their release from said plurality of trays, and said supporting means including a pair of angular slots in said frame, a pair of trunnions on each of said plurality of trays received in said slots whereby said shifting means will sequentially engage said trunnions of said selected one of said trays to thereby move said selected tray in said pair of slots from the sheet retaining position to the sheet release position.

4. In combination, a printing apparatus having a rotatably mounted platen defining a sheet feed path thereabout and drive means for rotating said platen; a drop sheet feeder for moving sheets of sheet material from a storage location and into said sheet feed path of said printing apparatus comprising:

a drop sheet feeder frame mounted on the printing apparatus, sheet feed means supported in said frame for advancing associated sheets of sheet material introduced thereinto along a drop sheet feeder feed path registering at its end with a sheet feed path of said printing apparatus, a plurality of trays adapted to receive at least one sheet of sheet material therebetween, means supporting said plurality of trays in a generally upstanding position within said frame above said sheet feed means for reciprocal movement between a sheet retaining position and a sheet release position, means shifting selected trays from said sheet retaining position to said sheet release position, shifting means effecting sequential shifting of said trays for introducing the associated sheets of sheet material in a storage location between said selected trays into said feed path defined by said drop sheet feeder, means movably mounted on said frame for reciprocating movement with respect to said drop sheet feeder feed path to block said drop sheet feeder feed path and position the leading edges of the associated sheets of sheet material at a predetermined point relative to a platen of said printing apparatus following their release from said plurality of trays, drop sheet feeder drive means operatively connecting said platen and said shifting means, whereby rotation of said platen will operate said drop sheet feeder drive means and said shift means connected thereto to shift said selected trays and release the associated sheets of sheet material, and each of said plurality of trays having a magnetic holder at the upper end portion thereof for retaining the upper ends of said plurality of trays in close proximity to each other.

5. A drop sheet feeder for moving sheets of sheet material from a storage location therein and along a sheet feed path to an associated printer or the like comprising:

a frame adapted to be mounted on a printer or the like, sheet feed means supported in said frame for advancing associated sheets of sheet material introduced thereinto along a sheet feed path registering at its end with a sheet feed path of the associated printer, a plurality of trays adapted to receive at least one sheet of sheet material therebetween, means supporting said plurality of trays in a generally upstanding position within said frame above said sheet feed means for reciprocal movement between a sheet retaining position and a sheet release position, means for shifting selected trays from said sheet retaining position to said sheet release position, said shifting means effecting sequential shifting of said trays for introducing the associated sheets of sheet material in a storage location between said selected trays into said feed path defined by said sheet feed means, means movably mounted on said frame for movement into said feed path defined by said sheet feed means to block said feed path defined by said sheet feed means and position the leading edges of the associated sheets of sheet material following their release from said plurality of trays, said supporting means including a pair of angular slots in said frame, a pair of trunnions on each of said plurality of trays received in said slots whereby said shifting means will sequentially engage said trunnions of said selected one of said trays to thereby move said selected tray in said pair of slots from the sheet retaining position to the sheet release position, and each of said plurality of trays including a pair of trunnions extending therefrom received within said support means, whereby said trunnions and said holders of adjacent trays of said plurality of trays cooperate to space said adjacent trays from one another for reception of the associated sheets of sheet material therebetween.

6. In combination, a printing apparatus having a rotatably mounted platen defining a sheet feed path thereabout and drive means for rotating said platen; a drop sheet feeder for moving sheets of sheet material from a storage location and into said sheet feed path of said printing apparatus comprising:

a drop sheet feeder frame mounted on the printing apparatus, sheet feed means supported in said frame for advancing associated sheets of sheet material introduced thereinto along a drop sheet feeder feed path registering at its end with a sheet feed path of said printing apparatus, a plurality of trays adapted to receive at least one sheet of sheet material therebetween, means supporting said plurality of trays in a generally upstanding position within said frame above said sheet feed means for reciprocal movement between a sheet retaining position and a sheet release position, means shifting selected trays from said sheet retaining position to said sheet release position, shifting means effecting sequential shifting of said trays for introducing the associated sheets of sheet material in a storage location between said selected trays into said feed path defined by said drop sheet feeder, means movably mounted on said frame for reciprocating movement with respect to said drop sheet feeder feed path to block said drop sheet feeder feed path and position the leading edges of the associated sheets of sheet material at a predetermined point relative to a platen of said printing apparatus following their release from said plurality of trays, drop sheet feeder drive means operatively connecting said platen and said shifting means, whereby rotation of said platen will operate said drop sheet feeder drive means and said shift means connected thereto to shift said selected trays and release the associated sheets of sheet material, and said shifting means including:

a picker finger having a tray engaging end and a cam follower end, said finger being oscillatably mounted on said frame for sequentially moving said selected trays between the retaining and release positions, and a picker cam operatively disposed adjacent said cam follower end to rotate said picker finger to sequentially move said selected one of said trays and release the associated sheets of sheet material.

* * * * *